US005976453A

United States Patent [19]

Nilsson et al.

[11] Patent Number: 5,976,453

[45] Date of Patent: Nov. 2, 1999

[54] DEVICE AND PROCESS FOR EXPANDING STRAND MATERIAL

[75] Inventors: Bengt G. Nilsson; Lennart O. Svensson, both of Falkenberg, Sweden

[73] Assignee: Owens-Corning Sweden AB, Falkenberg, Sweden

[21] Appl. No.: 09/106,670

[22] Filed: Jun. 29, 1998

[51] Int. Cl.[6] ..... B29C 67/00

[52] U.S. Cl. ..... 264/555; 28/273; 83/402; 83/588; 83/639.1; 226/97.1; 425/302.1

[58] Field of Search ..... 264/555; 425/302.1; 28/273; 83/402, 588, 639.1; 226/97.1

[56] References Cited

U.S. PATENT DOCUMENTS

| | | |
|---|---|---|
| 2,982,082 | 5/1961 | Pool . |
| 3,054,714 | 9/1962 | Johnston . |
| 3,295,162 | 1/1967 | Forceville . |
| 3,340,684 | 9/1967 | Shichman . |
| 3,577,614 | 5/1971 | Price . |
| 3,613,830 | 10/1971 | Hubbell . |
| 3,619,322 | 11/1971 | Fleissner . |
| 3,714,686 | 2/1973 | Schmid et al. . |
| 3,775,209 | 11/1973 | Paquette et al. . |
| 3,823,450 | 7/1974 | Ankudowicz et al. . |
| 3,955,643 | 5/1976 | Clark . |
| 4,401,610 | 8/1983 | Ohberg . |
| 4,569,471 | 2/1986 | Ingemansson et al. . |
| 4,609,519 | 9/1986 | Pichard et al. . |
| 4,631,791 | 12/1986 | Symon . |
| 4,724,588 | 2/1988 | Runkel . |
| 4,774,985 | 10/1988 | Broadbelt et al. . |
| 4,829,640 | 5/1989 | Greb et al. . |
| 4,898,770 | 2/1990 | Dunbar . |
| 4,952,366 | 8/1990 | Gelin . |
| 4,961,700 | 10/1990 | Dunbar . |
| 5,009,941 | 4/1991 | Pollet et al. . |
| 5,020,199 | 6/1991 | Gorrafa . |
| 5,024,890 | 6/1991 | Pollet et al. . |
| 5,026,410 | 6/1991 | Pollet et al. . |
| 5,034,181 | 7/1991 | Billiu . |
| 5,041,260 | 8/1991 | Johnson et al. . |
| 5,076,393 | 12/1991 | Howerton et al. . |
| 5,146,052 | 9/1992 | Dümmel . |
| 5,220,137 | 6/1993 | Howerton et al. . |
| 5,256,366 | 10/1993 | Wejrock et al. . |
| 5,281,778 | 1/1994 | Chelodyn et al. . |
| 5,326,009 | 7/1994 | Kobayashi et al. . |
| 5,418,339 | 5/1995 | Bowen et al. . |
| 5,766,541 | 6/1998 | Knutsson et al. ..... 264/571 |

FOREIGN PATENT DOCUMENTS

| | | |
|---|---|---|
| 446064 | 9/1991 | European Pat. Off. . |
| 615 014 | 9/1994 | European Pat. Off. . |
| 692616 | 1/1996 | European Pat. Off. . |
| 2 158 001 | 11/1985 | United Kingdom . |

OTHER PUBLICATIONS

Patent Application U.S. Serial No. 08/802,492 (Attorney Docket No. 23579C) entitled "Preformed Sound Absorbing Material For Engine Exhaust Muffler" filed on Feb. 20, 1997 by Goran Knutsson.

*Primary Examiner*—Leo B. Tentoni
*Attorney, Agent, or Firm*—Inger H. Eckert

[57] ABSTRACT

An expanding device for expanding strand material into a wool-type product includes outer and internal nozzle sections. The outer nozzle section has an entrance portion, an intermediate portion and an exit portion. At least a portion of the internal nozzle section is adapted to be received in the outer nozzle section. It includes a main body portion and a needle portion extending from the main body portion. The main body and needle portions include a first inner passage through which strand material passes to be expanded into a wool-type product. The needle and main body portions define with inner surfaces of the entrance and intermediate portions of the outer nozzle section an inner chamber. The main body portion has at least two bores extending through the main body portion which receive gas supplied by a gas stream source. The at least two bores communicate with the inner chamber and define a path for gas to travel to the inner chamber. The gas passes into the inner chamber and causes the strand material to move through the first passage. The gas also effects expansion of the strand material into a wool-type product.

30 Claims, 4 Drawing Sheets

DEVICE AND PROCESS FOR EXPANDING STRAND MATERIAL

TECHNICAL FIELD AND INDUSTRIAL APPLICABILITY OF THE INVENTION

This invention relates to a device and process for expanding strand material into a wool-type product.

BACKGROUND OF THE INVENTION

U.S. Pat. No. 4,569,471 to Ingemansson et al. describes a process and apparatus for feeding lengths of continuous glass fiber strands into a muffler outer shell. The apparatus includes a nozzle for expanding the fiber strands into a wool-like material before the fiber strands enter the outer shell. It has been found that the nozzle disclosed in the '471 patent is only capable of expanding strand material to a density of about 70 grams/liter or more. However, it would be desirable to expand strand material into a wool-like material which has a density of less than 70 grams/liter, for example, between about 30 grams/liter to about 60 grams/liter. Such lower density wool-type material is desirable for many sound and thermal insulation applications.

SUMMARY OF THE INVENTION

The present invention is directed to a device and process for expanding strand material into a wool-type product. Such products are intended for use as acoustic and/or thermal insulation in automotive and industrial applications. The device of the present invention is capable of expanding strand material into a wool-type product having a density of from about 30 grams/liter to about 69 grams/liter. Such low density wool-type products are desirable for use as sound absorbing material in engine exhaust mufflers, and as silencers for HVAC systems. Low density wool-type products may also be used in other thermal and acoustic insulation applications. The device of the present invention is also capable of expanding strand material into a wool-type product having a density of from about 70 grams/liter to about 140 grams/liter. Such high density wool-type products are desirable for use as sound absorbing material in engine exhaust mufflers, and as silencers for HVAC systems. High density wool-type products may also be used in other thermal and acoustic insulation applications. The device of the present invention is an improvement over the nozzle disclosed in the previously-discussed '471 patent as it requires less compressed air, i.e., the flow rate of air going into the nozzle is less than that required by the nozzle of the '471 patent. Hence, a given plant in which such devices are used will require fewer or lower capacity air compressors. Further, smaller tubing and regulators associated with the air compressors can be employed. A reduction of noise within the plant will also result due to the reduction in the quantity of compressed air used.

In accordance with a first aspect of the present invention, an expanding device is provided for expanding strand material into a wool-type product. The device comprises outer and internal nozzle sections. The outer nozzle section has an entrance portion, an intermediate portion and an exit portion. At least a portion of the internal nozzle section is adapted to be received in the outer nozzle section. It includes a main body portion and a needle portion extending from the main body portion. The main body and needle portions include a first inner passage through which strand material passes to be expanded into a wool-type product. The needle and main body portions define with inner surfaces of the entrance and intermediate portions of the outer nozzle section an inner chamber. The main body portion has at least two bores extending through the main body portion which receive gas supplied by a gas stream source. The at least two bores communicate with the inner chamber and define a path for gas to travel to the inner chamber. The gas passes into the inner chamber and causes the strand material to move through the first passage. The gas also effects expansion of the strand material into a wool-type product.

The main body portion may have from about two to about twelve bores. However, it is preferred that the main body portion have only two or three bores. Each bore may have an inner diameter of from about 3 mm to about 5 mm, and preferably about 4 mm. Each bore may have a length of from about 20mm, to about 50 mm, and preferably about 30 mm.

The needle portion is spaced from about 0.75 mm to about 3.0 mm and preferably about 1.9 mm from the inner surface of the intermediate portion of the outer nozzle section. An outer surface of a terminal end of the needle portion has a conical shape and extends at an angle of from about 30 degrees to about 75 degrees and preferably about 60 degrees to a longitudinal axis of the needle portion. Similarly, the intermediate portion of the outer nozzle section has a conical shape and extends at an angle of from about 30 degrees to about 75 degrees and preferably about 60 degrees to a longitudinal axis of the outer nozzle section.

The first passage has a first inner diameter which is from about 3.0 mm to about 6.0 mm and preferably about 4 mm.

The exit portion of the outer nozzle section may comprise intermediate and outer nozzle segments. The intermediate nozzle segment is integral with the intermediate portion of the outer nozzle section and has a second inner passage. The outer nozzle segment is coupled to the intermediate nozzle segment and has a third inner passage. The strand material passes through the second and third passages. The second and third passages have an inner diameter which is from about 6.0 mm to about 12.0 mm and preferably about 8 mm.

The device may further comprise a strand material locking device coupled to the main body of the internal nozzle section. The strand material locking device comprises a main body housing and a diaphragm. The main body housing has an inner cavity, a strand material inlet, a strand material outlet, fluid passages which communicate with the inner cavity and a fluid inlet which communicates with the fluid passages. The fluid inlet and the fluid passages provide a path for pressurized fluid to pass into the inner cavity from a source of pressurized fluid. The diaphragm is positioned within the inner cavity and has a fourth inner passage through which strand material passes. The diaphragm expands in response to pressurized fluid entering the inner cavity so as to prevent the strand material from moving through the first, second, third and fourth inner passages, The main body portion of the internal nozzle section may include a connector portion which is adapted to be coupled to the gas stream source. The connector portion provides a path for pressurized gas to travel from the source to the at least two bores in the main body portion.

The expanding device may further include a cutting device coupled between the intermediate and outer nozzle segments of the exit portion of the outer nozzle section. The cutting device may comprise a cylinder, a piston and a knife. The cylinder has an inner cavity and includes a main body portion arid a cylinder cap. The cylinder main body portion includes a first opening through which pressurized fluid passes into the inner cavity The cylinder cap is coupled to the main body portion and includes a second opening through which pressurized fluid passes into the inner cavity.

The piston is located within the cylinder inner cavity. The knife has a first size and is coupled to the piston so as to reciprocate with the piston in response to pressurized fluid entering the cylinder through the first and second openings.

The cylinder inner cavity comprises a first bore having a second size and a second bore having a third size which is less than the second size. The third size of the second bore is slightly larger than the first size of the knife such that a gap exists between the second bore and the knife. The gap provides a path for pressurized fluid entering into the first bore through the first opening to exit the first bore between the knife and the second bore so as to prevent strand material from entering the first and second inner cavity bores.

In accordance with a second aspect of the present invention, a process is provided for expanding strand material into a wool-type product. The process includes the step of providing an expanding device. The device comprises outer and internal nozzle sections. The outer nozzle section has an entrance portion, an intermediate portion and an exit portion. The internal nozzle section is adapted to be received in the outer nozzle section and includes a main body portion and a needle portion extending from the main body portion. The main body and needle portions include a first inner passage through which strand material passes to be expanded into a wool-type product. The needle and main body portions define with inner surfaces of the entrance and intermediate portions of the outer nozzle section an inner chamber. The main body portion has at least two bores extending through the main body portion which are adapted to receive gas. The at least two bores communicate with the inner chamber and define a path for gas to travel to the inner chamber. The process further includes the step of supplying pressurized gas to the at least two bores such that the pressurized gas passes into the inner chamber and causes the strand material to move through the first inner passage. The pressurized gas also effects expansion of the strand material into a wool-type product.

The step of providing pressurized gas may comprise the step of providing pressurized gas at a pressure of from about 4.5 bars to about 7.0 bars to the at least two bores such that pressure within the inner chamber is from about 1.5 bars to about 2.5 bars. The pressurized gas effects expansion of the strand material into a wool-type product having a density of from about 30 grams per liter to about 60 grams per liter.

The step of providing pressurized gas may comprise the step of providing pressurized gas at a pressure of from about 2.5 bars to about 4.5 bars to the at least two bores such that pressure within the inner chamber is from about 0.7 bar to about 1.5 bars. The pressurized gas effects expansion of the strand material into a wool-type product having a density of from about 70 grams per liter to about 140 grams per liter.

In accordance with a third aspect of the present invention, a strand material locking device is provided for engaging and holding strand material stationary. The locking device comprises a piston having a nose, a spring and a cylinder portion. The cylinder portion includes a main body section and a cylinder cap. The main body section has an inner cavity, a passage, and first and second bores. The piston is located within the inner cavity and is capable of reciprocating therein between retracted and engaged positions. The nose extends through the second bore and engages the strand material when the piston is in the engaged position. The cylinder cap includes a fluid inlet through which pressurized fluid enters the inner cavity to cause the piston to move to its engaged position. The spring returns the piston to its retracted position when the fluid inlet no longer receives pressurized fluid.

The first bore extends between and communicates with the inner cavity and a fluid source. The piston nose has a first size and the second bore has a second size which is larger than the first size so as to define a gap between the piston nose and the second bore. The gap provides a path for pressurized fluid entering the inner cavity through the first bore to exit the inner cavity between the piston nose and the second bore so as to prevent strand material from entering the inner cavity.

DETAILED DESCRIPTION AND PREFERRED EMBODIMENTS OF THE INVENTION

A device and a process are provided for expanding strand material into a wool-type product. Such products are intended for use as acoustic and/or thermal insulation in automotive and industrial applications.

The continuous strand material may comprise any conventional reinforcement glass fiber strand. The term "glass fiber strand" as used herein shall mean a strand formed from a plurality of glass fibers. An example of such a strand is a commercially available roving having, for example, 4000 fibers. For muffler applications, glass fiber strands are preferred as glass fibers are resistant to the high levels of heat produced in the interior of an engine exhaust muffler. Preferably, the strands are formed from E-glass or S-glass type fibers. For industrial applications such as thermal insulation for chimney ducts or venting systems, glass fiber strands arc also preferred. It is further contemplated that the continuous strand material may comprise basalt fiber strands or fiber strands formed of other materials.

Figure 1:
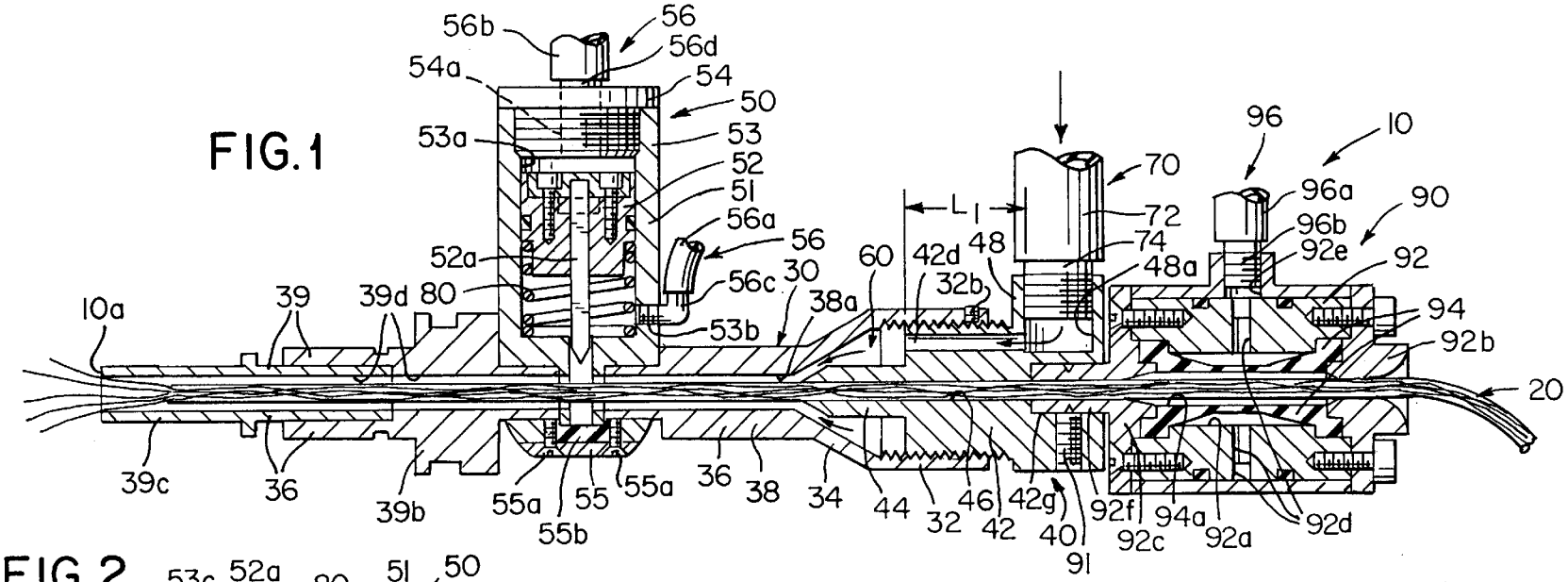
FIG. 1 is a cross sectional view of an expanding device constructed in accordance with a first embodiment of the present invention.

Referring now to FIG. 1, an expanding or texturing device 10 is provided for expanding strand material 20 into a wool-type product. The device 10 comprises an outer nozzle section 30 and an internal nozzle section 40. The outer nozzle section 30 has an entrance portion 32, an intermediate portion 34 and an exit portion 36. The exit portion 36, in the illustrated embodiment, includes an intermediate nozzle segment 38 and an outer nozzle segment 39. The intermediate nozzle segment 38 is integral with the intermediate portion 34 of the outer nozzle section 30 and has a second inner passage 38*a*. The intermediate segment 38 is coupled to a cutting device 50, which will be described below. The outer nozzle segment 39 is also coupled to the cutting device 50 and has a third inner passage 39*a*. In the illustrated embodiment, the outer nozzle segment 39 comprises first and second parts 39*b* and 39*c*. It is contemplated that the first and second parts 39*b* and 39*c* could comprise a single, integral element (not shown).

As is illustrated in FIG. 1, the strand material passes through the second and third passages 38*a* and 39*a* as it moves through the device 10. The second passage 38*a* has an inner diameter $D_1$, which is from about 6.0 mm to about 12.0 mm and preferably about 8 mm, see FIG. 2. The third passage 39*a* has an inner diameter $D_2$ which is from about 6.0 mm to about 12.0 mm and preferably about 8 mm. Preferably, $D_1$ is substantially equal to $D_2$.

A portion of the internal nozzle section 40 is received in the outer nozzle section 30, see FIG. 1. The internal nozzle section 40 includes a main body portion 42 and a needle portion 44 integral with and extending from the main body portion 42. The main body and needle portions 42 and 44 include a first inner passage 46 through which the strand material 20 passes as it moves through the device 10. The first passage 46 has a first inner diameter $D_N$ which is from about 3 mm to about 6 mm, and preferably about 4 mm, see FIG. 3.

Figure 3:
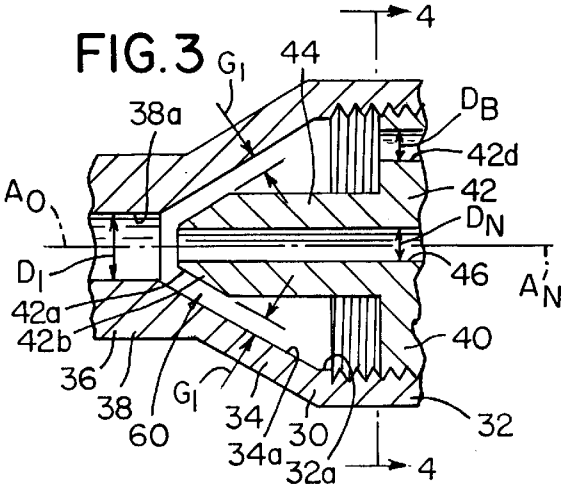
FIG. 3 is an enlarged sectional view of portions of the outer and internal nozzle sections illustrated in FIG. 1.

The main body and needle portions 42 and 44 define with inner surfaces 32*a* and 34*a* of the entrance and intermediate portions 32 and 34 of the outer nozzle section 30 an inner chamber 60, see FIG. 3. An outer surface 42*a* of a terminal end 42*b* of the needle portion 42 is spaced from about 0.75 mm to about 3.0 mm and preferably about 1.9 mm from the inner surface 34*a* of the intermediate portion 34 of the outer nozzle section 30 such that a first gap G1 exists between the outer surface 42*a* of the needle portion 44 and the inner surface 34*a* of the intermediate portion 34.

An outer surface of the main body portion 42 and a portion of the inner surface of the entrance portion 32 of the outer nozzle section 30 are threaded. Thus, the main body portion 42 may be rotated so as to set the proper gap $G_1$ between outer surface 42*a* of the needle portion 44 and the inner surface 34*a* i of the intermediate portion 34. A set screw 32*b* releasably locks the main body portion 42 in position relative to the entrance portion 32.

The outer surface 42*a* of the terminal end 42*b* of the needle portion 42 has a conical shape and extends at an angle of from about 30 degrees to about 75 degrees and preferably about 60 degrees to a longitudinal axis $A_N$ of the needle portion 44, see FIG. 3. Similarly, the intermediate portion 34 of the outer nozzle section 30 has a conical shape and extends at an angle of from about 30 degrees to about 75 degrees and preferably about 60 degrees to a longitudinal axis $A_O$ of the outer nozzle section.

Figure 4:
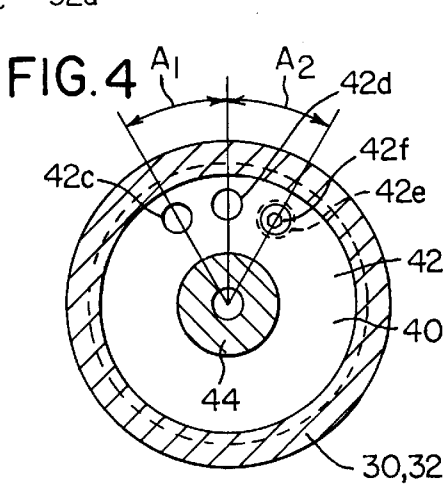
FIG. 4 is view taken along view line 4—4 illustrated in FIG. 3.

The main body portion 42 has three bores 42*c*–42*e* extending it. The bores 42*c* –42*e* communicate with the inner chamber 60. In the illustrated embodiment, a bolt 42*f* is provided in the bore 42*e* so as to prevent the bore 48*e* from receiving pressurized gas. The bores 42*c* and 42*d* receive a pressurized gas, air in the illustrated embodiment, from a gas stream source 70 and define paths for pressurized or compressed gas to travel to the inner chamber 60. Each of the bores 42*c*–42*e* has an inner diameter $D_B$ of from about 3 mm to about 5 mm, and preferably about 4 mm. Each of the bores 42*c*–42*e* also has a length $L_1$ of from about 20 mm to about 50 mm, and preferably about 30 mm. The bores 42*c* and 42*d* are separated from one another by an angle $A_1$ of from about 28 to about 32 and preferably about 30 degrees, see FIG. 4. Similarly, the bores 42*d* and 42*f* are separated from one another by an angle $A_2$ of from about 28 to about 32 and preferably about 30 degrees.

The main body portion 42 may have between two and twelve bores. However, it is preferred that the main body portion 42 have only two or three bores. It is also contemplated that the bolt 42*f* may be removed from the bore 42*e* such that the bore 42*e* provides an additional path for air supplied by the source 70 to flow into the inner chamber 60.

The gas stream source 70 comprises an air compressor (not shown), a flow control valve (not shown), a hose 72 coupled to the compressor and a fitting 74 provided at the end of the hose 72. The main body portion 42 includes a connector portion 48 having a threaded passage 48*a* which communicates with the bores 42*c*–42*e*. The fitting 74 is threaded into the passage 48*a*. Pressurized air flows from the compressor through the hose 72 and the fitting 74 to the passage 48*a*. From the passage 48*a*, the pressurized air passes through the bores 42*c* and 42*d* and into the inner chamber 60. The pressurized gas advances the strand material 20 through the first, second and third passages 46, 38*a* and 39*a*. It also separates and entangles the fibers of the strand material 20 so that the strand material 20 emerges from the distal end 10*a* of the device 10 as a continuous, length of a "fluffed-up" material or wool-type product.

In the illustrated embodiment, the gas stream source 70 provides pressurized air to the inner chamber 60 only during discrete filling cycles. That is, at the beginning of a filling cycle, pressurized air is provided to the inner chamber 60. At the end of the filling cycle, the gas stream source 70 ceases providing pressurized air to the inner chamber 60. A discrete filling cycle involves expanding or texturizing a given length of strand material 20 such that at the end of the cycle, a single container, casing or the like is filled with the expanded strand material and the given length of strand material is separated or cut from a remaining length of strand material 20 provided by a source(not shown)of strand material. An example of one filling cycle is the filling of one muffler casing. It is contemplated that more than one expanding device 10 may feed strand material into a single muffler casing.

As noted above, a cutting device 50 is coupled between the intermediate nozzle segment 38 and the outer nozzle segment 39. It comprises a cylinder 51, a piston 52, a knife 52*a*, and a spring 80, see FIGS. 1 and 2. The cylinder 51 has an inner cavity 53*a* and includes a main body portion 53, a cylinder cap 54 and a cylinder base 55. The cylinder base 55 is coupled to the main body portion 53 via bolts 55*a*. The cylinder cap 54 is threadedly secured to the main body portion 53. The piston 52 is located within the cylinder inner cavity 53*a* and is capable of reciprocating therein. The knife 52*a* is coupled to the piston 52 so as to move with the piston 52. The spring 80 is provided in the inner cavity 53*a* and biases the piston 52 upward toward the cylinder cap 54. The base 55 includes an anvil 55*b* made from a polymeric material, such as neoprene, which acts as a stop for the knife 52*a*.

The main body portion 53 includes a first opening 53*b* through which pressurized fluid passes into the inner cavity 53*a* below the piston 52. The cylinder cap 54 includes a second opening 54*a* through which pressurized fluid passes into the inner cavity 53*a* above the piston 52. A conventional fluid supply source provides pressurized fluid, air in the illustrated embodiment, to the first and second openings 53*b* and 54*a*. The fluid supply source 56 comprises an air compressor (not shown), flow control valves (not shown), first and second hoses 56*a* and 56*b* and first and second fittings 56*c* and 56*d* which are connected respectively to the first and second hoses 56*a* and 56*b*. The fittings 56*c* and 56*d* are threadedly received in the first and second openings 53*b* and 54*a*.

When the fluid supply source 56 supplies pressurized air to the second opening 54*a* at the end of a filling cycle, the piston 52 and the knife 52*a* are caused to move downwardly against the upward force of the spring 80 toward the strand material 20 such that strand material 20 located between the knits 52*a* and the anvil 55*b* is cut. Once the strand material 20 has been cut, the fluid supply source 56 stops providing pressurized air to the second opening 54*a*. The fluid supply source 56 begins supplying pressurized air to the first opening 53*b* immediately after cutting. The air passing through the first opening 53*b* works with the spring 80 to return the piston 52 and the knife 52*a* to their home position, shown in FIG. 1. Preferably, pressurized air is provided to the first opening 53*b* immediately after the knife 52*a* severs the strand material 20 and continues to be delivered to the inner cavity 53*a* until after the piston 52 and the knife 52*a* have completely returned to their home position, e.g., for about 0.8 second to about 1.5 seconds. The spring 80 also functions to maintain the piston 52 and the knife 52*a* in their home position when pressurized air is no longer provided to the first opening 53*b*.

Once the piston 52 and the knife 52*a* are returned to their home position, the fluid supply source 56 ceases providing pressurized air to the first opening 53*b*. Once a new filling cycle begins, i.e., the strand material 20 starts to move through the device 10 so as to be expanded, the fluid supply source 56 again provides pressurized air to the first opening 53*b*. Pressurized air continues to be supplied to the first opening 53*b* until the filling cycle has been completed, at which point the fluid supply source 56 ceases providing pressurized air to the first opening 53*b*. As noted above, immediately after cutting, pressurized air is again provided to the first opening 53*b* by the fluid supply source 56 for a time period sufficient to allow the piston 52 and the knife 52*a* to return to their home position.

The knife 52*a* has a first size which, in the illustrated embodiment, comprises a length of about 35 mm, a width of about 16 mm, and a thickness of about 4 mm. These dimensions may be changed.

Figure 2:
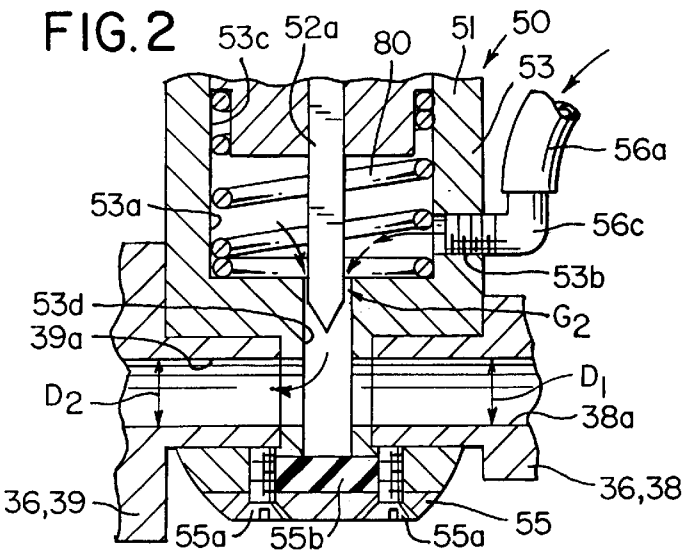
FIG. 2 is an enlarged sectional view of a portion of the cutter illustrated in FIG. 1.

The cylinder inner cavity 53*a* comprises a first bore 53*c* having a second size and a second bore 53*d* having a third size which is less than the second size, see FIG. 2. The third size of the second bore 53*d* is slightly larger than the first size of the knife 52*a* such that a gap $G_2$ exists between the second bore 53*d* and the knife 52*a*. The gap $G_2$ provides a path for pressurized fluid entering the first bore 53*c* through the first opening 53*b* to exit the first bore 53*c*. Thus, during a filling cycle, i.e., while texturized strand material 20 emerges from the distal end 10*a* of the device 10, the air entering the first bore 53*c* through the first opening 53*b* and exiting through the gap $G_2$ prevents strand material 20 or portions of strand material 20 from entering the first and second inner cavity bores 53*c* and 53*d*. This prevents the cutter 50 from becoming inoperable due to a build up of strand material 20 in the first bore 53*c*. Such a build up of material 20 might prevent the piston 52 and the cutter 52*a* from moving a sufficient distance toward the anvil 55*b* to cut the strand material 20.

The device 10 further comprises a strand material locking device 90 coupled to the main body portion 42 of the internal nozzle section 40. The strand material locking device 90 comprises a main body housing 92 and an annular diaphragm 94. The main body housing 92 has an inner cavity 92*a*, a strand material inlet 92*b*, a strand material outlet 92*c*, fluid passages 92*d*, a fluid inlet 92*e* which communicates with the passages 92*d*, and an extending portion 92*f*. The extending portion 92*f* is received within a recess 42*g* formed in the main body portion 42 and is releasably held therein via a set screw 91. The fluid passages 92*d* communicate with the inner cavity 92*a* and provide a path for pressurized fluid, air in the illustrated embodiment, to pass into the inner cavity 92*a* from a source of pressurized fluid 96. The diaphragm 94 is positioned within the inner cavity 92*a* and has a fourth inner passage 94*a* through which strand material 20 passes. The diaphragm 94 expands in response to pressurized fluid entering the inner cavity 92*a* so as to releasably lock or hold the strand material 20 in a fixed position relative to the main body housing 92. Thus, the material 20 is prevented from moving through the first, second, third and fourth inner passages 46, 38*a*, 39*a*, and 94*a* when the diaphragm is expanded.

The pressurized fluid source 96 comprises an air compressor (not shown), a flow control valve (not shown), a hose 96*a* coupled to the compressor, and a fitting 96*b* provided at the end of the hose 96*a*. The fitting 96*b* is threadedly received in a portion of the fluid inlet 92*e*. Pressurized air flows from the compressor through the hose 96*a* and the fitting 96*b* to the fluid inlet 92*e*. From the inlet 92*e*, the pressurized air passes through the passages 92*d* to the inner cavity 92*a* causing the diaphragm 94 to expand. The expanded diaphragm 94 grips the strand material 20 and holds it stationary. The fluid source 96 is caused to provide pressurized fluid to the inner cavity 92*a* just before the cutter 50 is operated to cut the strand material 20. Once the strand material 20 has been severed, the fluid source 96 releases the pressurized air from the inner cavity 92*a* causing the diaphragm 94 to release the strand material 20.

The device 10 of the present invention is capable of expanding strand material into a wool-type product having a density of from about 30 grams/liter to about 60 grams/liter. To form such a low density product, pressurized gas is provided to the bores 42*c* and 42*d* at a pressure of from about 4.5 bars to about 7.0 bars. As a result, the pressure within the inner chamber 60 is from about 1.5 bars to about 2.5 bars. The feeding speed of the strand material 20 is from about 300 meters/minute to about 400 meters/minute. It is also contemplated that the bolt 42*f* may be removed from the bore 42*e* so as to allow pressurized air to pass therethrough.

The device 10 of the present invention is also capable of expanding strand material into a wool-type product having a density of from about 70 grams/liter to about 140 grams/liter. To form such a high density product, pressurized gas is provided to the bores 42*c* and 42*d* at a pressure of from about 2.5 bars to about 4.5 bars. Consequently, the pressure within the inner chamber 60 is from about 0.7 bar to about 1.5 bars. The feeding speed of the strand material 20 is from about 400 meters/minute to about 600 meters/minute. It is also contemplated that the bolt 42*f* may be removed from the bore 42*e* so as to allow pressurized air to pass therethrough.

The expanded strand material emerging from the distal end 10*a* of the device 10 may be fed into a muffler (not shown). For example, the device 10 may be used in place of nozzle 9 described in U.S. Pat. No. 4,569,471, the disclosure of which is incorporated herein by reference.

It is also contemplated that the strand material 20 may be fed to the device 10 by a conventional braking device. Thus, the speed at which the strand material 20 passes into and through the device 10 is determined by the speed of the braking device (meters/minute) and the air pressure within the chamber 60. The braking device may also measure the length of strand material 20 fed into device 10 and provide an appropriate signal to a controller (not shown) once a predefined amount of strand material 20 has moved through the device 10. At that point, the controller causes the gas stream source 70 to cease supplying pressurized air to the inner chamber 60, the fluid supply source 56 to cease supplying pressurized air to the first opening 53*b*, the locking device 90 to grip the strand material 20, and the cutter 50 to sever the strand material 20. Preferably, each muffler casing or cavity receives a continuous strand of expanded material.

Figure 5:
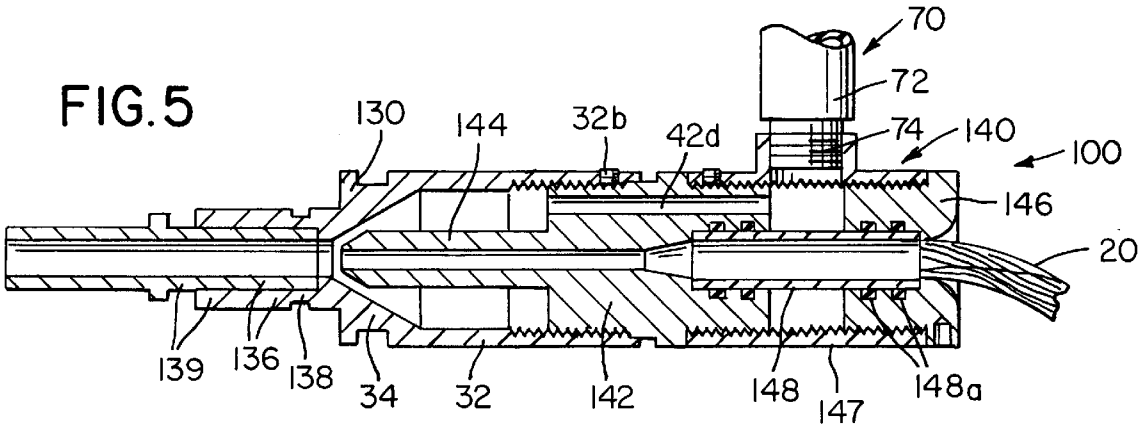
FIG. 5 is a cross sectional view of an expanding device constructed in accordance with a second embodiment of present invention.

An expanding device 100, formed in accordance with a second embodiment of the present invention, is shown in FIG. 5, wherein like reference numerals indicate like elements. In this embodiment, the outer nozzle section 130 is constructed in essentially the same manner as the outer nozzle section 30 illustrated in FIG. 1, except that the intermediate nozzle segment 138 and the outer nozzle segment 139 of the exit portion 136 are not separated from one another and not coupled to opposing sides of a cutter. Further, the intermediate nozzle segment 138 is shorter than segment 38 illustrated in FIG. 1. The internal nozzle section 140 includes a main body portion 142, a needle portion 144 integral with and extending from the main body portion 142, an inlet 146, a connector portion 147 coupling the inlet 146 to the main body portion 142, and a passage tube 148 extending between the inlet 146 and the main body portion 142. The main body portion 142 and the inlet 146 are threadedly received in the connector portion 147. O-rings 148*a* seal the passage tube 148 to the inlet 146 and the main body portion 142. The needle portion 144 and the main body portion 142 are constructed in essentially the same manner as the needle portion 44 and main body portion 42 illustrated in FIG. 1. A locking device 90 and a cutter 50 are not provided in the device 100.

Figure 6:
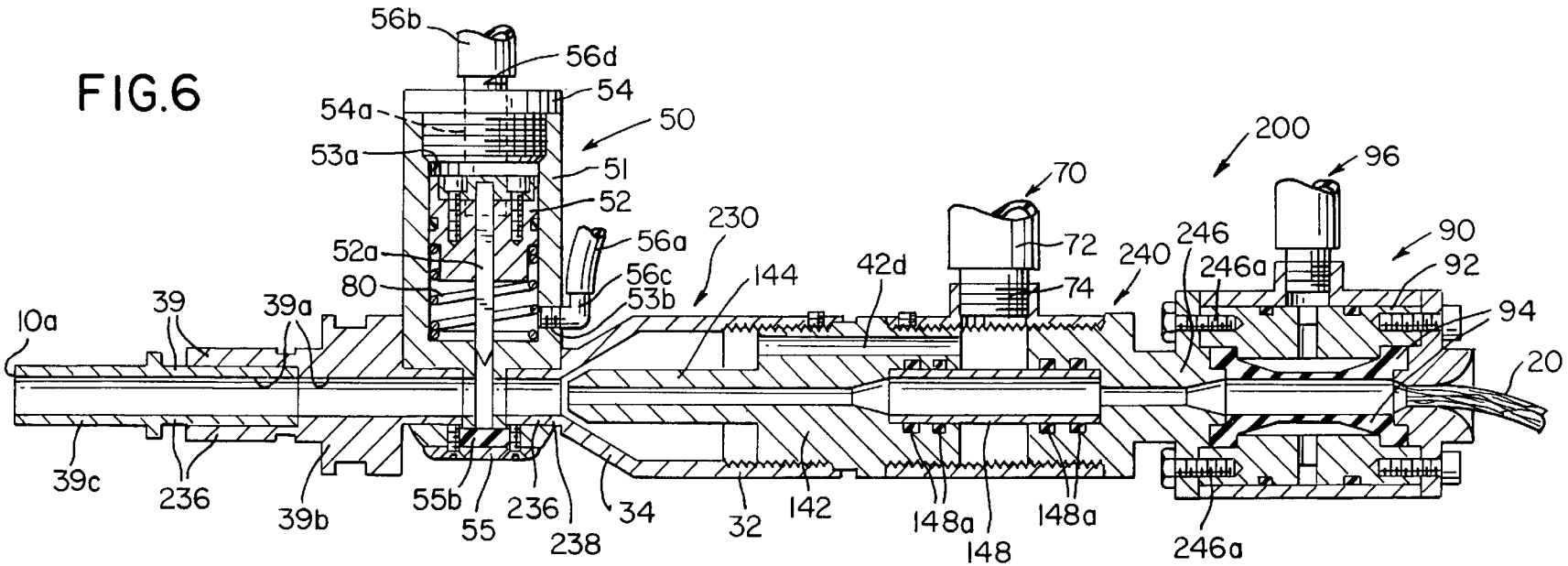
FIG. 6 is a cross sectional view of an expanding device constructed in accordance with a third embodiment of present invention.

An expanding device 200, formed in accordance with a third embodiment of the present invention, is shown in FIG. 6, wherein like reference numerals indicate like elements. In this illustrated embodiment, the outer nozzle section 230 is constructed in essentially the same manner as the outer nozzle section 30 illustrated in FIG. 1, except that the intermediate nozzle segment 238 is shorter than the intermediate nozzle segment 38 illustrated in FIG. 1. It is also contemplated, and may even be preferred, to have the intermediate segment 238 formed so that it is of substantially the same length as the nozzle segment 38 illustrated in FIG. 1. The cutter 250 is essentially the same as the cutter 50 illustrated in FIG. 1. The internal nozzle section 240 is essentially the same as the internal nozzle section 140 illustrated in FIG. 5, except that the inlet 246 is coupled to a locking device 90 via bolts 246*a*. The locking device 90 is constructed in essentially the same manner as the locking device 90 illustrated in FIG. 1.

Figure 7:
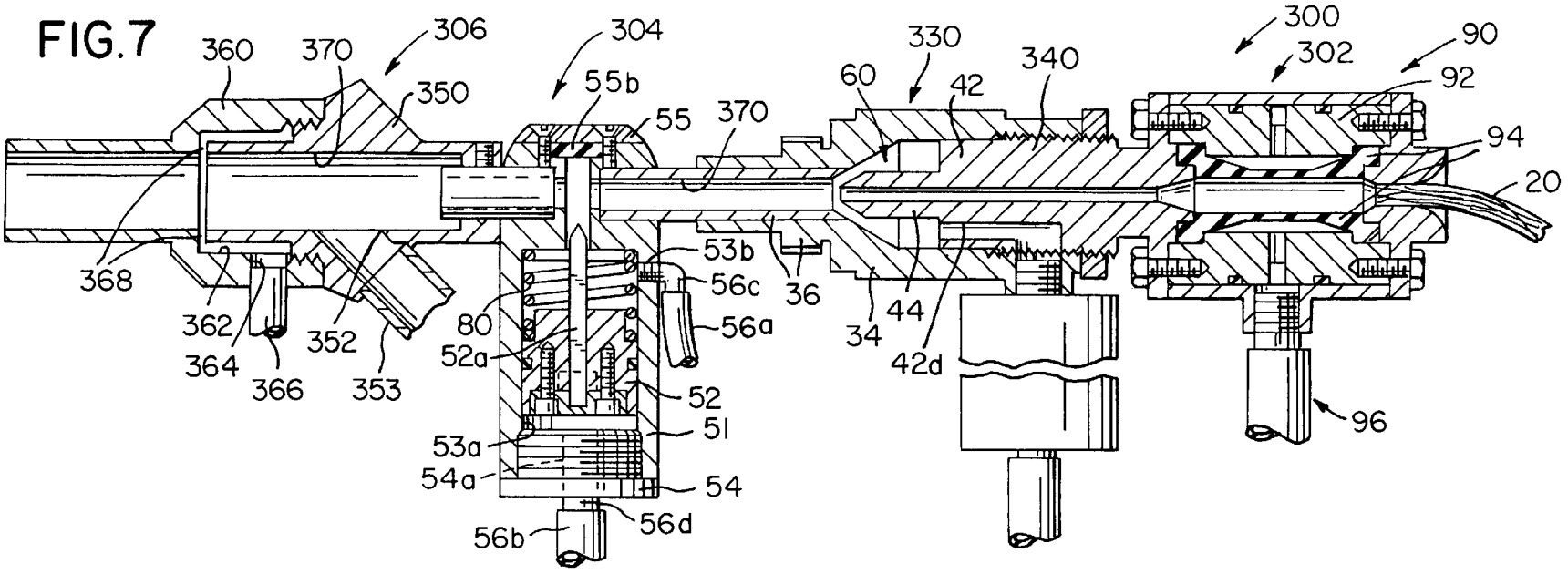
FIG. 7 is a cross sectional view of a strand material feeding apparatus constructed in accordance with the present invention.

A strand material feeding apparatus 300 constructed in accordance with the present invention is illustrated in FIG. 7, wherein like reference numerals indicate like elements. It is similar in construction to the feed apparatus 500 disclosed in patent application U.S. Ser. No. 08/753,987, filed on Dec. 3, 1996, which is entitled "PREFORMED SOUND ABSORBING MATERIAL FOR ENGINE EXHAUST MUFFLER," now U.S. Pat. No. 5,766,541, the disclosure of which is, hereby incorporated by reference. The feeding apparatus 500 comprises a fiber feeding portion 302, a knife portion 304 and a binder feeding portion 306. The knife portion 304 is constructed in essentially the same manner as the cutter 50 illustrated in FIG. 1.

The fiber feeding portion 302 comprises an outer nozzle section 330 and an internal nozzle section 340. The outer nozzle section 330 is constructed in essentially the same manner as the outer nozzle section 30 illustrated in FIG. 1 and the internal nozzle section 340 is constructed in essentially the same manner as the internal nozzle section 40 illustrated in FIG. 1.

The binder feeding portion 306 is constructed in essentially the same manner as the binder feeding portion 506 disclosed in U.S. Pat. No. 5,766,541. Briefly, it comprises first and second nozzle portions 350 and 360. The first nozzle portion 350 includes a binder supply inlet 352 which is connected to and communicates with a binder feeding tube 353. Binder entering the supply inlet 352 is diagonally fed into a central passage 370 through which strand material 20 passes. The first and second nozzle portions 350 and 360 define an annular cavity 362. The second nozzle portion 360 includes an aperature 364 which is connected to and communicates with a water feeding tube 366. Water entering the aperture 364 is fed into the annular cavity 362. The water exits the cavity 362 through a gap 368 between the first and second nozzle portions 350 and 360 and enters the passage 370 to wet the binder. The binder and expanded strand material may be supplied to a mold to form a preform as discussed in U.S. Pat. No. 5,766,541.

Figure 8:
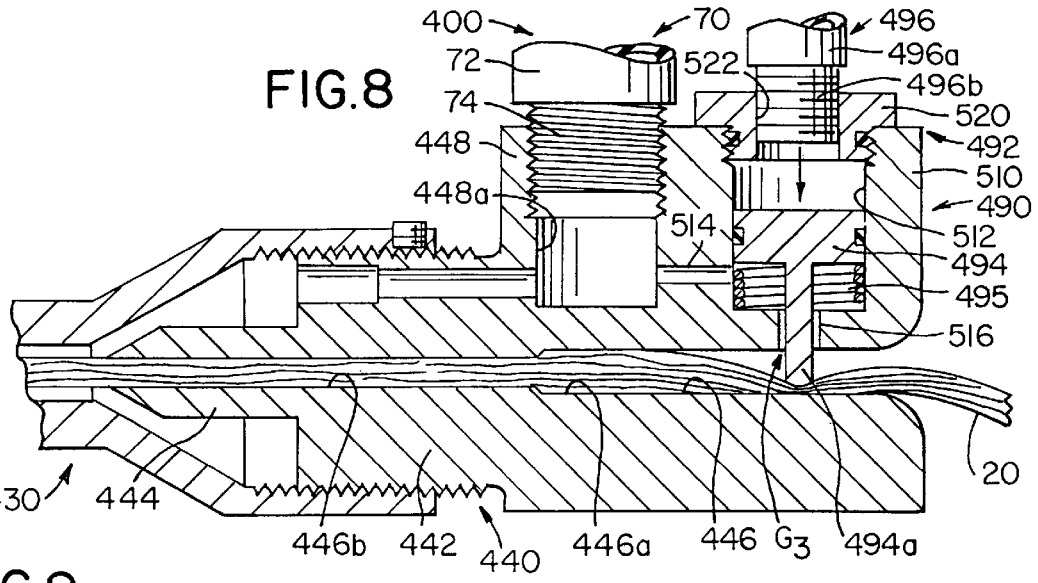
FIG. 8 is a cross sectional view of a portion of an expanding device constructed in accordance with a fourth embodiment of the present invention.
Figure 9:
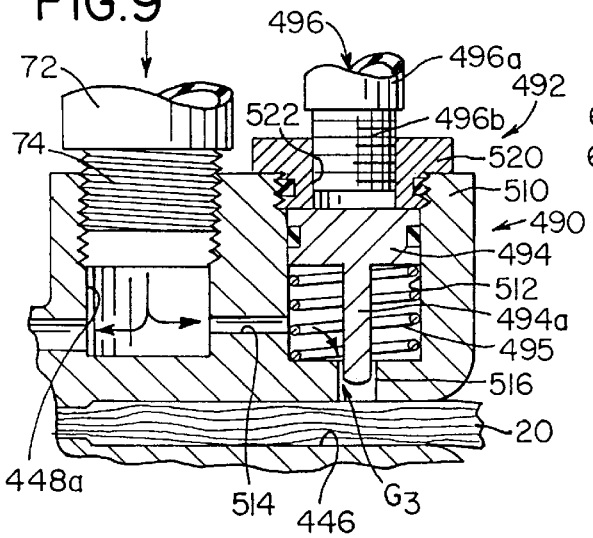
FIG. 9 is a cross sectional view of a portion of the device illustrated in FIG. 8 with the piston shown in its disengaged position.

An expanding device 400, formed in accordance with a fourth embodiment of the present invention, is shown in FIGS. 8 and 9, wherein like reference numerals indicate like elements. In this embodiment, the outer nozzle section 430 is constructed in essentially the same manner as the outer nozzle section 30 illustrated in FIG. 1. The internal nozzle section 440 includes a main body portion 412 and a needle portion 444 integral with and extending from the main body portion 442. The needle portion 444 is formed in essentially the same manner as the needle portion 44 illustrated in FIG. 1. The main body portion 442 is formed in essentially the same manner as the main body portion 42 illustrated in FIG. 1, except that a strand material locking device 490 is integral with the main body portion 442. The device 400 further includes a cutting device (not shown) which is constructed in essentially the same manner as the device 50 illustrated in FIG. 1.

The strand material locking device 490 comprises a cylinder portion 492, a piston 494 and a spring 495. The cylinder portion 492 includes a main body section 510 and a cylinder cap 520 which is threadedly secured to the main body section 510. The main body section 510 includes an inner cavity 512 and first and second bores 514 and 516. The piston 494 is located within the inner cavity 512 and is capable of reciprocating therein. The spring 495 is provided within the inner cavity 512 and biases the piston 494 upward toward the cylinder cap 520.

The first bore 514 in the mail body section 510 extends between and communicates with the inner cavity 512 and a passage 448*a* of a connector portion 448. In this embodiment, the locking device 490 is axially displaced from the connector portion 448. The passage 448*a* is coupled to a gas stream source 70 including a hose 72 coupled to a compressor (not shown) and a fitting 74 provided at the end of the hose 74. Pressurized air is provided to the passage 448*a* by the source 70 in the same manner that passage 48*a* receives pressurized air from the source 70, as discussed above. The !;second bore 516 extends between and communicates with the inner cavity 512 and a first passage 446 through which the strand material 20 passes as it moves through the device 400. The passage 446 is shown including a first section 446a having a first diameter and a second section 446*b* having a second diameter which is less than the first diameter of the first section 446*a*. For example, the first diameter may be about 5 mm while the second diameter is about 4 mm. The first section 446*a* is provided with a larger diameter so as to allow joined or spliced strands to pass into and through the passage 446 without stopping.

The cylinder cap 520 includes a fluid inlet 522 which communicates with a pressurized fluid source 496. The pressurized fluid source 496 comprises an air compressor (not shown), a flow control valve (not shown), a hose 496*a* coupled to the compressor, and a fitting 496*b* provided at the end of the hose 496*a*. The fitting 496*b* is threadedly received in a portion of the fluid inlet 522. Pressurized air flows from the compressor through the hose 496*a* and the fitting 496*b* to the fluid inlet 522. From the inlet 522, the pressurized air passes into the inner cavity 512 causing the piston 494 to move downwardly against the spring 495. As the piston 494 moves downwardly, a nose 494*a* of the piston 494 moves through the second bore 516 so as to engage the strand material 20. The nose 494*a* grips the strand material 20 and holds it stationary in the first passage 446. The fluid source 496 is caused to provide pressurized fluid to the inner cavity 512 just before the cutter is operated to cut the strand material 20. Once the strand material 20 has been severed, the fluid source 496 releases the pressurized air from the inner cavity 512, thereby allowing the spring 495 to return the piston 494 to its retracted position, see FIG. 9.

The nose 494*a* of the piston 494 has a first size and the second bore 516 has a second size which is larger than the first size. Hence, a gap $G_3$ exists between the second bore 516 and the piston nose 494*a* when the nose 494*a* is in its strand material engaging position, see FIG. 8. The gap $G_3$ provides a path for pressurized air entering the inner cavity 512 through the first bore 514 to exit the inner cavity 512. Thus, during a filling cycle, the pressurized air entering the inner cavity 512 through the first bore 514 and exiting through the gap $G_3$ prevents strand material 20 or portions of strand material 20 from entering the inner cavity 512. This prevents the locking device 490 from becoming inoperable due to a build up of strand material 20 in the inner cavity 512. Such a build up of material 20 might prevent the piston nose 494*a* from properly engaging the strand material 20 just before or during a cutting operation.

It is further contemplated that the strand material locking device 490 may not be integral with the main body portion 442. In this embodiment, the locking device 490 is coupled to main body portion 442 and the main body section 510 includes a passage through which the strand material passes.

Figure 11:
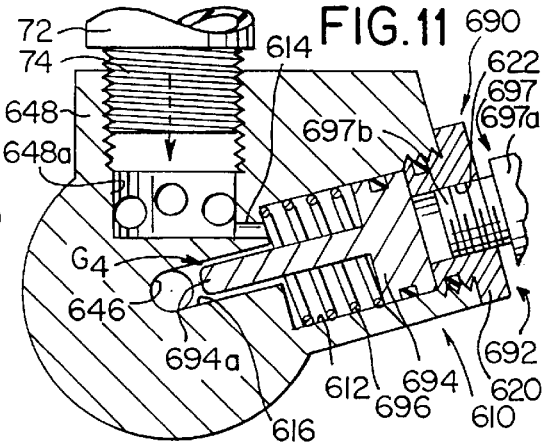
FIG. 11 is a cross sectional view taken along view line 11 in FIG. 10.
Figure 10:
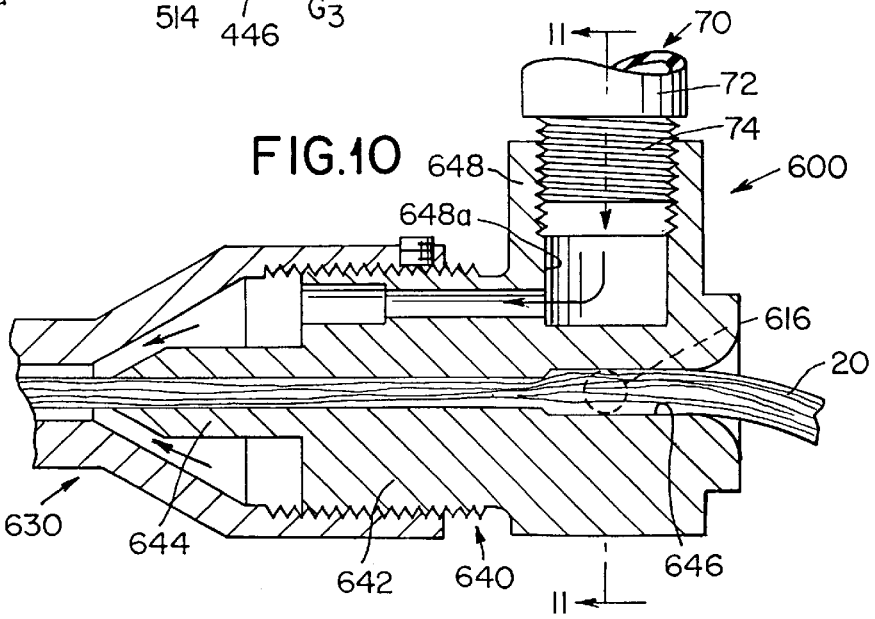
FIG. 10 is a cross sectional view of a portion of an expanding device constructed in accordance with a fifth embodiment of the present invention.

An expanding device 600, formed in accordance with a fifth embodiment of the present invention, is shown in FIGS. 10 and 11, wherein like reference numerals indicate like elements. In this embodiment, the outer nozzle section 630 is constructed in essentially the same manner as the outer nozzle section 30 illustrated in FIG. 1. The internal nozzle section 640 includes a main body portion 642 and a needle portion 644 integral with and extending from the main body portion 642. The needle portion 644 is formed in essentially the same manner as the needle portion 44 illustrated in FIG. 1. The main body portion 642 is formed in essentially the same manner as the main body portion 42 illustrated in FIG. 1, except that a strand material locking device 690 is integral with the main body portion 642. The device 600 further includes a cutting device (not shown) which is constructed in essentially the same manner as the device 50 illustrated in FIG. 1.

The strand material locking device 690 comprises a cylinder portion 692, a piston 694 and a spring 696. In order to reduce the overall length of the device 600, the cylinder portion 692 is generally axially in-line with and angularly offset to a passage 648*a* of a connector portion 648, see FIG. 11. The cylinder portion 692 includes a main body section 610 and a cylinder cap 620 threadedly secured to the main body section 610. The main body section 610 includes an inner cavity 612 and first and second bores 614 and 616. The piston 694 is located within the inner cavity 612 and is capable of reciprocating therein. The spring 696 is provided within the inner cavity 612 and biases the piston 694 toward the cylinder cap 620.

The first bore 614 in the main body section 610 extends between and communicates with the passage 648*a* and the inner cavity 612. The passage 648*a* is coupled to a gas stream source 70 including a hose 72 coupled to a compressor (not shown) and a fitting 74 provided at the end of the hose 74. Pressurized air is provided to the passage 648*a* by the source 70 in the same manner that passage 48*a* receives pressurized air from the source 70, as discussed above. The second bore 616 extends between and communicates with the inner cavity 612 and a first passage 646 through which the strand material 20 passes as it moves through the device 600.

The cylinder cap 620 includes a fluid inlet 622 which communicates with a pressurized fluid source 697. The pressurized fluid source 697 comprises an air compressor (not shown), a flow control valve (not shown), a hose 697*a* coupled to the compressor, and a fitting 697*b* provided at the end of the hose 697*a*. The fitting 697*b* is threadedly received in a portion of the fluid inlet 622. Pressurized air flows from the compressor through the hose 697*a* and the fitting 697*b* to the fluid inlet 622. From the inlet 622, the pressurized air passes into the inner cavity 612 causing the piston 694 to move against the spring 696. As the piston 694 moves toward the passage 646, a nose 694*a* of the piston 694 moves through the second bore 616 so as to engage the strand material 20 in the passage 646. The nose 694*a* grips the strand material 20 and holds it stationary so as to prevent it from moving through the device 600. The fluid source 697 is caused to provide pressurized fluid to the inner cavity 612 just before the cutter is operated to cut the strand material 20. Once the strand material 20 has been severed, the fluid source 697 releases the pressurized air from the inner cavity 612, thereby allowing the spring 696 to return the piston 694 to its retracted position, see FIG. 11.

The nose 694*a* of the piston 694 has a first size and the second bore 616 has a second size which is larger than the first size. Hence, a gap $G_4$ exists between the second bore 616 and the piston nose 694*a* when the nose 694*a* is in its strand material locking position (not shown). The gap $G_4$ provides a path for pressurized air entering the inner cavity 612 through the first bore 614 to exit the inner cavity 612. Thus, during a filling cycle, the pressurized air entering the inner cavity 612 through the first bore 614 and exiting through the gap $G_4$ prevents strand material 20 or portions of strand material 20 from entering the inner cavity 612. This prevents the locking device 690 from becoming inoperable due to a build up of strand material 20 in the inner cavity 612. Such a build up of material 20 might prevent the piston nose 694*a* from properly engaging the strand material 20 just before or during a cutting operation.

What is claimed is:

1. A device for expanding strand material into a wool-type product comprising:

an outer nozzle section having an entrance portion, an intermediate portion and an exit portion; and an internal nozzle section adapted to be received in said outer nozzle section and including a main body portion and a needle portion extending from said main body portion, said main body and needle portions including a first inner passage through which strand material passes to be expanded into a wool-type product, said needle and main body portions defining with inner surfaces of said entrance and intermediate portions of said outer nozzle section an inner chamber, said main body portion having at least two bores extending through said main body portion which receive gas supplied by a gas stream source, said at least two bores communicate with said inner chamber and define a path for gas to travel to said inner chamber, said gas passing into said inner chamber and causing said strand material to move through said first passage, said gas also effecting expansion of said strand material into a wool-type product.

2. A device as set forth in claim 1, wherein said main body portion has no more than three bores extending through said main body portion.

3. A device as set forth in claim 2, wherein each of said bores has an inner diameter of from about 3 mm to about 5 mm.

4. A device as set forth in claim 3, wherein each of said bores has a length of from about 20 mm to about 50 mm.

5. A device as set forth in claim 4, wherein said needle portion is spaced about 0.75 mm to about 3.0 mm from said inner surface of said intermediate portion of said outer nozzle section.

6. A device as set forth in claim 5, wherein an outer surface of a terminal end of said needle portion has a conical shape and extends at an angle of from about 30 degrees to about 75 degrees to a longitudinal axis of said needle portion.

7. A device as set forth in claim 6, wherein said intermediate portion of said outer nozzle section has a conical shape and extends at an angle of from about 30 degrees to about 75 degrees to a longitudinal axis of said outer nozzle section.

8. A device as set forth in claim 7, wherein said first passage has a first inner diameter which is from about 3.0 mm to about 6.0 mm.

9. A device as set forth in claim 8, wherein said exit portion of said outer nozzle section comprises intermediate and outer nozzle segments, said intermediate nozzle segment is integral with said intermediate portion of said outer nozzle section and has a second inner passage, and said outer nozzle segment is coupled to said intermediate nozzle segment and has a third inner passage, said strand material passing through said second and third passages.

10. A device as set forth in claim 9, wherein said second and third passages having an inner diameter which is from about 6.0 mm to about 12.0 mm.

11. A device as set forth in claim 10, further comprising a strand material locking device coupled to said main body portion of said internal nozzle section, said strand material locking device comprising:

a main body housing having an inner cavity, a strand material inlet and an outlet, fluid passages which communicate with said inner cavity and a fluid inlet which communicates with said fluid passages; and a diaphragm positioned within said inner cavity and having a fourth inner passage through which strand material passes, said diaphragm expanding in response to pressurized fluid entering said inner cavity through said fluid passages and said fluid inlet so as to prevent said strand material from moving through said first, second, third and fourth inner passages.

12. A device as set forth in claim 10, further comprising a strand material locking device integral with said main body portion of said internal nozzle section, said strand material locking device comprising:

a piston having a nose adapted to engage said strand material;

a spring; and a cylinder portion including a main body section and a cylinder cap, said main body section having an inner cavity and first and second bores, said piston being located within said inner cavity so as to reciprocate within said inner cavity between retracted and engaged positions, said nose extending through said second bore and engaging said strand material when said piston is in said engaged position, said cylinder cap including a fluid inlet through which pressurized fluid enters said inner cavity to cause said piston to move to its engaged position, said spring returning said piston to its retracted position when said fluid inlet no longer receives pressurized fluid.

13. A device as set forth in claim 12, wherein said main body portion further includes a connector portion which is adapted to be coupled to said gas stream source, said connector portion providing a path for pressurized gas to travel from said source to said at least two bores in said main body portion.

14. A device as set forth in claim 13, wherein said strand material locking device is axially displaced from said connector portion.

15. A device as set forth in claim 13, wherein said strand material locking device is angularly offset from said connector portion.

16. A device as set forth in claim 13, wherein said first bore extends between and communicates with said connector portion and said inner cavity.

17. A device as set forth in claim 16, wherein said piston nose has a first size and said second bore has a second size which is larger than said first size so as to define a gap between said piston nose and said second bore, said gap providing a path for pressurized fluid entering said inner cavity through said first bore to exit said inner cavity between said piston nose and said second bore so as to prevent strand material from entering said inner cavity.

18. A device as set forth in claim 1, wherein said main body portion further includes a connector portion which is adapted to be coupled to said gas stream source, said connector portion providing a path for pressurized gas to travel from said source to said at least two bores in said main body portion.

19. A device as set forth in claim 1, wherein a cutting device is coupled to said exit portion of said outer nozzle section.

20. A device as set forth in claim 19, wherein said cutting device comprises:

a cylinder having an inner cavity and including a main body portion with a first opening through which pressurized fluid passes into said inner cavity and a cylinder cap which is coupled to said main body portion and including a second opening through which pressurized fluid passes into said inner cavity;

a piston capable of reciprocating within said cylinder inner cavity; and a knife having a first size coupled to said piston so as to reciprocate with said piston in response to pressurized fluid entering said cylinder through said first and second openings.

21. A device as set forth in claim 20, wherein said cylinder inner cavity comprises a first bore having a second size and a second bore having a third size which is less than said second size, said third size of said second bore being slightly larger than said first size of said knife such that a gap exists between said second bore and said knife, said gap providing a path for pressurized fluid entering into said first bore through said first opening to exit said first bore between said knife and said second bore so as to prevent strand material from entering said first and second inner cavity bores.

22. A device as set forth in claim 1, wherein said main body portion has from about two to about twelve bores extending through said main body portion.

23. A strand material cutting device comprising:

a source of pressurized fluid;

a cylinder having an inner cavity and including a main body portion with a first opening through which pressurized fluid from said source passes in to said inner cavity, and a cylinder cap which is coupled to said main body portion and including a second opening through which pressurized fluid from said source passes into said inner cavity;

a piston capable of reciprocating within said cylinder inner cavity; and a knife having a first size coupled to said piston so as to reciprocate with said piston in response to pressurized fluid entering said cylinder through said first and second openings; and a spring provided in said main body portion inner cavity for biasing said piston and said knife to a retracted position.

24. A strand material cutting device as set forth in claim 23, wherein said cylinder inner cavity comprises a first bore having a second size and a second bore having a third size which is less than said second size, said third size of said second bore being slightly larger than said first size of said knife such that a gap exists between said second bore and said knife, said gap providing a path for pressurized fluid entering into said first bore through said first opening to exit said first bore between said knife and said second bore so as to prevent strand material from entering said first and second inner cavity bores.

25. A process for expanding strand material into a wool-type product comprising:

providing a device for expanding strand material into a wool-type product comprising an outer nozzle section having an entrance portion, an intermediate portion and an exit portion; and an internal nozzle section adapted to be received in said outer nozzle section and including a main body portion and a needle portion extending from said main body portion, said main body and needle portions including a first inner passage through which strand material passes to be expanded into a wool-type product, said needle and main body portions defining with inner surfaces of said entrance and intermediate portions of said outer nozzle section an inner chamber, said main body portion having at least two bores extending through said main body portion which are adapted to receive gas, said at least two bores communicate with said inner chamber and define a path for gas to travel to said inner chamber; and supplying pressurized gas to said at least two bores such that said pressurized gas passes into said inner chamber and causes said strand material to move through said first inner passage, said pressurized gas also effecting expansion of said strand material into a wool-type product.

26. A process as set forth in claim 25, wherein step of providing pressurized gas comprises the step of providing pressurized gas at a pressure of from about 4.5 bars to about 7.0 bars to said at least two bores such that pressure within said inner chamber is from about 1.5 bars to about 2.5 bars, said pressurized gas effecting expansion of said strand material into a wool-type product having a density of from about 30 grams per liter to about 60 grams per liter.

27. A process as set forth in claim 25, wherein step of providing pressurized gas comprises the step of providing pressurized gas at a pressure of from about 2.5 bars to about 4.5 bars to said at least two bores such that pressure within said inner chamber is from about 0.7 bar to about 1.5 bars, said pressurized gas effecting expansion of said strand material into a wool-type product having a density of from about 70 grams per liter to about 140 grams per liter.

28. A strand material locking device comprising:

a piston having a nose;

a spring; and a cylinder portion including a main body section and a cylinder cap, said main body section having an inner cavity, a passage, and first and second bores, said piston being located within said inner cavity so as to reciprocate within said inner cavity between retracted and engaged positions, said nose extending through said second bore and engaging said strand material when said piston is in said engaged position, said cylinder cap including a fluid inlet through which pressurized fluid enters said inner cavity to cause said piston to move to its engaged position, said spring returning said piston to its retracted position when said fluid inlet no longer receives pressurized fluid.

29. A device as set forth in claim 28, wherein said first bore extends between and communicates with said inner cavity and a fluid source.

30. A device as set forth in claim 29, wherein said piston nose has a first size and said second bore has a second size which is larger than said first size so as to define a gap between said piston nose and said second bore, said gap providing a path for pressurized fluid entering said inner cavity through said first bore to exit said inner cavity between said piston nose and said second bore so as to prevent strand material from entering said inner cavity.

* * * * *